US011072896B2

(12) United States Patent
Zagorsky

(10) Patent No.: US 11,072,896 B2
(45) Date of Patent: Jul. 27, 2021

(54) DISPENSER FOR BINARY VISCOUS FLUIDS WITH AGGREGATE

(71) Applicant: Eran Zagorsky, Porter Ranch, CA (US)

(72) Inventor: Eran Zagorsky, Porter Ranch, CA (US)

( * ) Notice: Subject to any disclaimer, the term of this patent is extended or adjusted under 35 U.S.C. 154(b) by 0 days.

(21) Appl. No.: 16/814,620

(22) Filed: Mar. 10, 2020

(65) Prior Publication Data

US 2020/0208358 A1 Jul. 2, 2020

Related U.S. Application Data

(63) Continuation of application No. 16/253,569, filed on Jan. 22, 2019, now Pat. No. 10,626,566.

(60) Provisional application No. 62/646,491, filed on Mar. 22, 2018.

(51) Int. Cl.

| | |
|---|---|
| ***E01C 23/22*** | (2006.01) |
| ***B05B 9/06*** | (2006.01) |
| *B05C 11/02* | (2006.01) |
| *B05C 5/00* | (2006.01) |
| *B05C 19/00* | (2006.01) |

(52) U.S. Cl.

CPC ..... *E01C 23/22* (2013.01); *B05B 9/06* (2013.01); *B05C 5/008* (2013.01); *B05C 11/02* (2013.01); *B05C 19/008* (2013.01)

(58) Field of Classification Search

CPC ..... E01C 23/22; B05B 9/06; B05C 5/008; B05C 11/02; B05C 19/008

USPC ..... 222/145.1, 145.5, 145.7, 608

See application file for complete search history.

(56) References Cited

U.S. PATENT DOCUMENTS

| | | | | |
|---|---|---|---|---|
| 3,067,987 | A * | 12/1962 | Ballou | B01F 15/00253 366/160.3 |
| 4,298,288 | A * | 11/1981 | Weisbrod | B28C 9/0454 366/11 |
| 4,366,918 | A * | 1/1983 | Naka | B01F 15/0454 222/134 |
| 4,705,217 | A * | 11/1987 | Hartley | B01F 3/088 222/135 |
| 4,789,100 | A * | 12/1988 | Sent | B01F 15/0243 239/61 |
| 5,388,761 | A * | 2/1995 | Langeman | B01F 15/00285 222/138 |
| 5,390,825 | A * | 2/1995 | Rockel | C10M 105/38 222/135 |
| 8,342,372 | B2 * | 1/2013 | Choiniere | B65D 77/065 222/608 |
| 9,089,869 | B2 * | 7/2015 | Galvin | E04D 15/00 |
| 2007/0000947 | A1 * | 1/2007 | Lewis | B01F 13/1055 222/132 |

(Continued)

*Primary Examiner* — Vishal Pancholi

(74) *Attorney, Agent, or Firm* — James A. Italia; Italia IP

(57) ABSTRACT

Apparatus for blending and applying plural substances including aggregate onto an environmental substrate is shown and described. The apparatus includes optionally a single power plant, plural pumps each fed by a respective hopper, and a blender blending pumped materials together. Dispensing ratios of the two pumps are mutually adjustable. An onboard air compressor delivers compressed air for atomizing blended materials as they are dispensed with the aggregate. Because materials may be curable or hardenable, flushing is enabled. The apparatus may be a free standing wheeled device.

7 Claims, 8 Drawing Sheets

(56) References Cited

U.S. PATENT DOCUMENTS

| | | | | |
|---|---|---|---|---|
| 2012/0181301 | A1* | 7/2012 | Choiniere | B05C 11/11<br>222/1 |
| 2013/0020405 | A1* | 1/2013 | Collins | B05B 9/007<br>239/142 |

* cited by examiner

DISPENSER FOR BINARY VISCOUS FLUIDS WITH AGGREGATE

CROSS-REFERENCE TO RELATED APPLICATION

This application is a Continuation and claims the benefit of priority to U.S. Non-Provisional Utility Application Ser. No. 16/253,569, filed Jan. 22, 2019, which claimed the benefit of priority to U.S. Provisional Utility Application Ser. No. 62/646,491, filed on Mar. 22, 2018, the contents of which are both incorporated by this reference.

FIELD OF THE INVENTION

The present invention relates to powered dispensers, and more particularly, to an apparatus which blends and also dispenses a binary viscous fluid under pressure.

BACKGROUND OF THE INVENTION

In buildings, roads, and other large structures, binary viscous fluids may be required for coatings, to define indicia, and for other purposes. Binary fluids may require special handling, for example, where freshly applied binary fluid is subject to curing, it is possible that control of proportions, appropriate blending and mixing, and urgency in application where curing starts spontaneously must all be accommodated.

An example is seen in application of lane divider lanes, direction arrows, and other indicia must be applied to a road surface. In prior practice, the first component of a binary fluid is applied first, followed by application of a second component of the binary fluid. This may be performed for example using two independent dispensing vehicles, one following immediately after the other. This scenario entails certain constraints to successful application of the final binary fluid. One potential problem is that the second component may not be applied in precise registration over the first component. A second problem is that after the second component is applied, it may be difficult to fully or effectively blend the first and second components to arrive at proper constituency. It may also be difficult to apply the first and second components at mutually satisfactory degrees of layer thickness, to control velocity from a discharge nozzle, and to control degree of atomization where atomization is needed, among others issues which may arise.

In actual practice, the situation may be even more complicated. Dispensed materials may include not only two components of a binary fluid, such as epoxy, which may include a base component and a hardening component, but may also include aggregates. As employed herein, an aggregate is a pulverized or comminuted material which becomes embedded or entrained in the binary fluid, but does not change its chemical nature. For example, rigid particles such as sand or hollow glass beads may be added to the binary fluid. Additionally, there may be a second, different aggregate, such as crumbled rubber particles. And in a still more complicated situation, two types of aggregates may be incorporated, both rigid and flexible particles (e.g., sand and crumbled rubber).

In conventional practice, this situation may require up to four separate applications to the environmental substrate: the two components of the binary fluid, and the two aggregates. This greatly introduces opportunity for mishaps and ineffective application of desired materials. Excessive time from the first to the last application, inaccuracy in quantities or location in laying down one or more materials being deposited, unintended variations in temperature, encountering rain, and other hazards make successful application subject to disruption and consequential failure.

Additionally, specifications of the materials being deposited or applied may change. For example, a different type of binary fluid requiring adjustment of proportions of its associated components may be required.

There exists a need in the art for apparatus to apply binary viscous fluids with aggregate successfully to environmental surfaces.

SUMMARY OF THE INVENTION

The present invention provides apparatus able to store components of binary fluids separately, mix the components together, and dispense a blended or mixed resulting binary fluid under pressure, for application to environmental surfaces. The mixed binary fluid is ejected in a single stream or spray, as mixing has already occurred.

To these ends, there is set forth an optionally wheeled apparatus including separate storage hoppers for each component of the binary fluid, a mixing chamber to mix the binary fluids together, pumps to propel unmixed components through the apparatus and through the mixing chamber, and compressed air for atomizing mixed binary fluid for ejection as a spray. The apparatus includes a chassis having wheels, a handle for maneuvering the chassis, a power plant for powering the pumps and air compressor, and appropriate controls.

The novel apparatus may incorporate optional modular or readily replaceable components, such as motors, pumps, and drive elements located between the motor and pumps. For example, where the drive elements include sprockets or gears, these may be readily replaceable to provide adjustment of drive ratios. This may be exploited to enable the apparatus to dispense different formulations of materials being blended and deposited.

Thus, four materials may be applied to an environmental stratum simultaneously, thereby overcoming the many potential problems which could cause failure of the operation.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
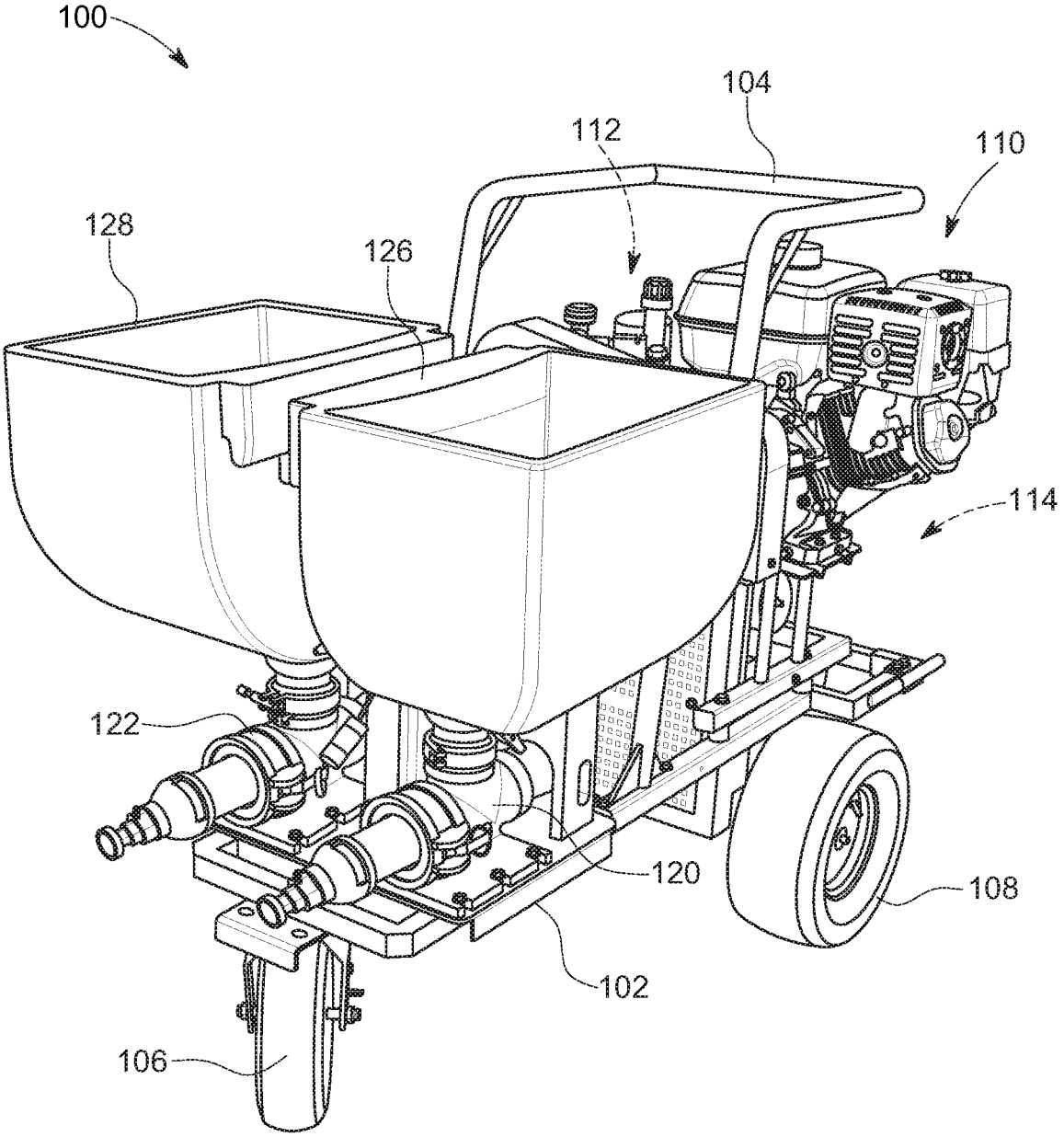
FIG. 1 is an image in perspective view of a dispensing apparatus according to at least one aspect of the disclosure.

Referring first to FIG. 1, according to at least one aspect of the invention, there is shown a dispenser 100 for dispensing binary viscous fluids (not shown), dispenser 100 comprising a chassis 102, a handle 104 for maneuvering dispenser 100, a front wheel 106, and a rear wheel 108. It will be appreciated that there are two rear wheels 108, one on each side of dispenser 100, with one rear wheel 108 concealed from view in FIG. 1.

Figure 2:
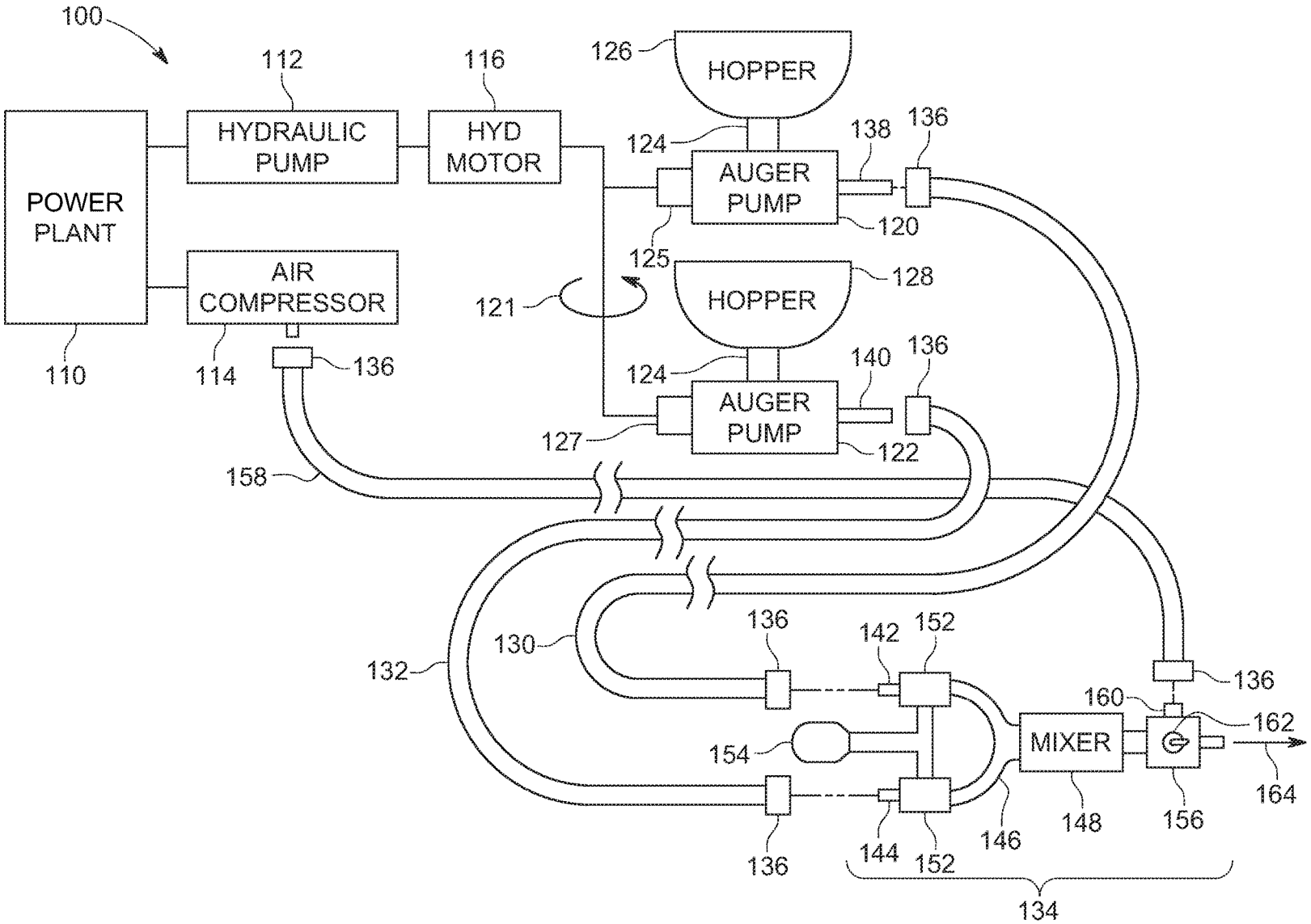
FIG. 2 is a diagrammatic view simplified to show only principal functional components of the dispensing apparatus of FIG. 1.

Referring principally to FIG. 2, but with the understanding that the components shown in FIG. 2 are present in dispenser 100 of FIG. 1, dispenser 100 includes a power plant 110, a hydraulic pump 112, and an air compressor 114. Power plant 110, shown in FIG. 1 as a gasoline internal combustion engine, rotates hydraulic pump 112 and air compressor 114. Hydraulic pump 112 rotates a hydraulic motor 116. Hydraulic motor 116 rotates a first auger pump 120 and a second auger pump 122. As employed herein, an auger pump will be understood to signify a pump which uses a helical screw device to propel pumped materials including materials that are viscous and include aggregate. Auger pumps will be understood to encompass progressive cavity pumps, screw pumps, or rotor stator pumps. It will be understood that due to the diagrammatic nature of FIG. 2, power transmission is not literally depicted, and that power plant 110 may include multiple torque shafts and other elements to drive hydraulic pump 112 and air compressor 114. Similarly, connection of hydraulic pump 112 to hydraulic motor 116 will include both supply and return hydraulic conduits enabling continuous and ongoing operation as described herein.

Unless otherwise indicated, the terms "first", "second", etc., are used herein merely as labels, and are not intended to impose ordinal, positional, or hierarchical requirements on the items to which these terms refer. Moreover, reference to, e.g., a "second" item does not either require or preclude the existence of, e.g., a "first" or lower-numbered item, and/or, e.g., a "third" or higher-numbered item.

Figure 5:
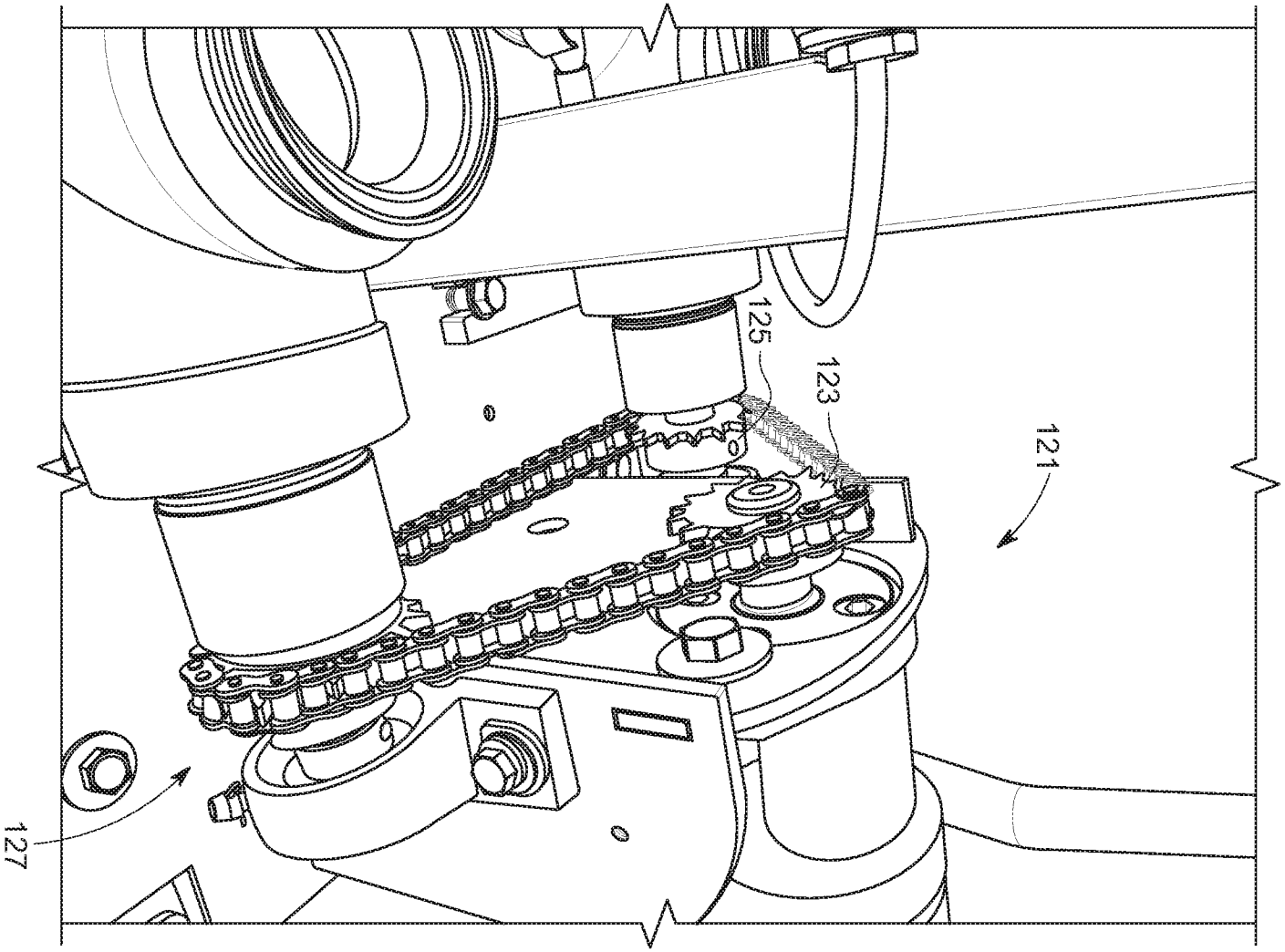
FIG. 5 is an enlarged perspective detail view of drive components shown diagrammatically at the upper center of FIG. 2.

Hydraulic motor 116 may drive first and second auger pumps 120, 122 by a mechanical drive 121. FIG. 5 shows an exemplary mechanical drive 121 as comprising a motor sprocket 123 driven by hydraulic motor 116, a first driven sprocket 125 driving first auger pump 120, and a second driven sprocket 127 driving second auger pump 122. A drive chain 129 engages motor sprocket 123 and first and second driven sprockets 125 and 127. It is appreciated that the first driven sprocket 125 and second driven sprocket 127 may be of the same size such that the ratio of the pumped material from the first auger pump 120 and second auger pump 122 is at a 1:1 ratio. Alternatively, the size of either sprocket can be changed such that the ratio of the pumped material from the first auger pump 120 and second auger pump 122 can be manipulated to a 1:2, 1:3, 1:4 ratio, or any other ratio deemed necessary according to the user's desire and/or specifications of the materials used. Alternatively, the ratio of the pumped material can be adjusted by substituting different sized auger pumps. For example, if first driven sprocket 125 and second driven sprocket 127 are the same size, a user can still achieve a 1:2 ratio by substituting one of the auger pumps for one that has twice the pumping capacity. If an extreme disparity in ratios is desired, such as 1:100, that may be achieved by providing appropriate volume pumps, and appropriately sized or toothed sprockets. To avoid any necessity of manufacturing many different sized sprockets or pumps, both sprockets and pumps may be selected to achieve an extremely disparate ratio.

With principal reference to FIG. 2, first and second auger pumps 120, 122 are supplied from respective first hopper 126 and second hopper 128. First and second hoppers 126, 128 may be of the open type, and may utilize gravity feed to supply contents to respective first and second auger pumps 120, 122 through closed or open chutes 124. Of course, first and second hoppers 126, 128 may comprise closed receptacles, or may comprise receptacles loaded other than from the top, should such characteristics be desired.

It is contemplated that one hopper 126 or 128 contain a mixed aggregate including comminuted solids and one component of a curable binary substance, while the other hopper 128 or 126 contain an activator that initiates hardening or curing. Where such substances are used, it may be desirable for example to dispense the mixed aggregate by the gallon, with activator being dispensed at a ratio of two fluid ounces per gallon of aggregate.

Figure 3:
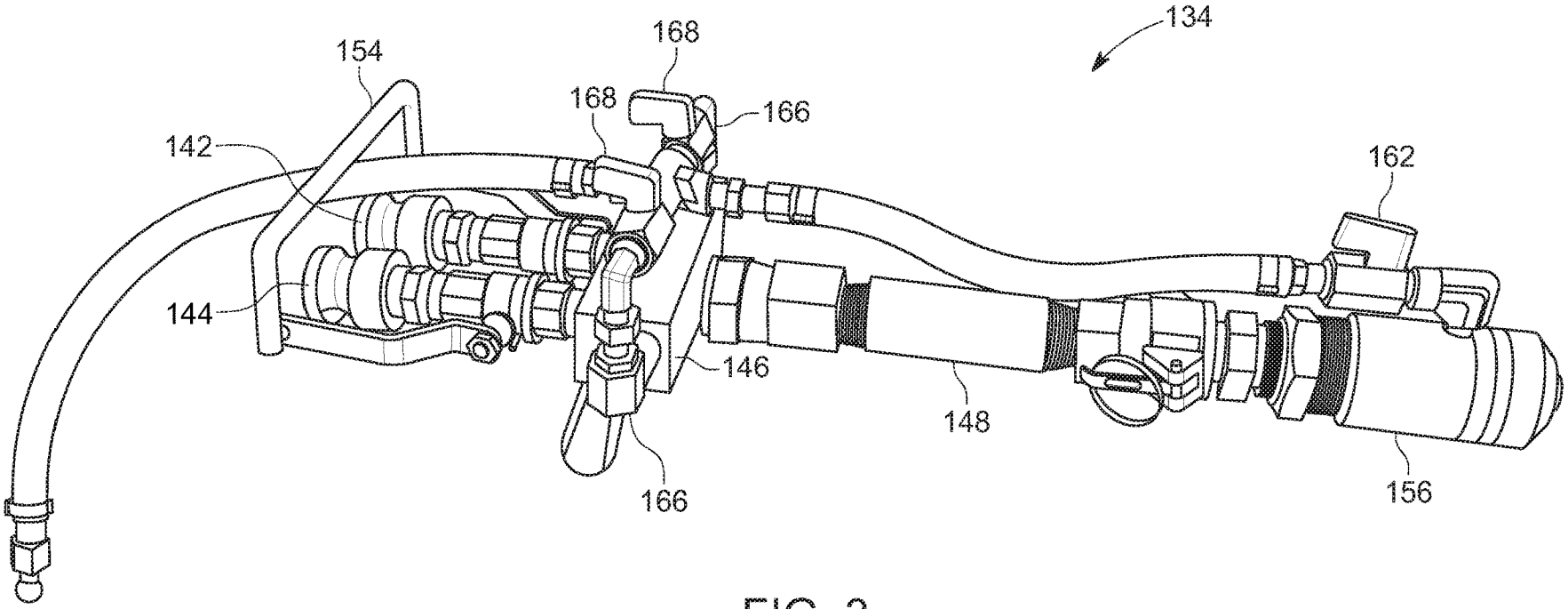
FIG. 3 is an image in perspective view of a dispensing nozzle usable with the dispensing apparatus of FIG. 1.
Figure 4:
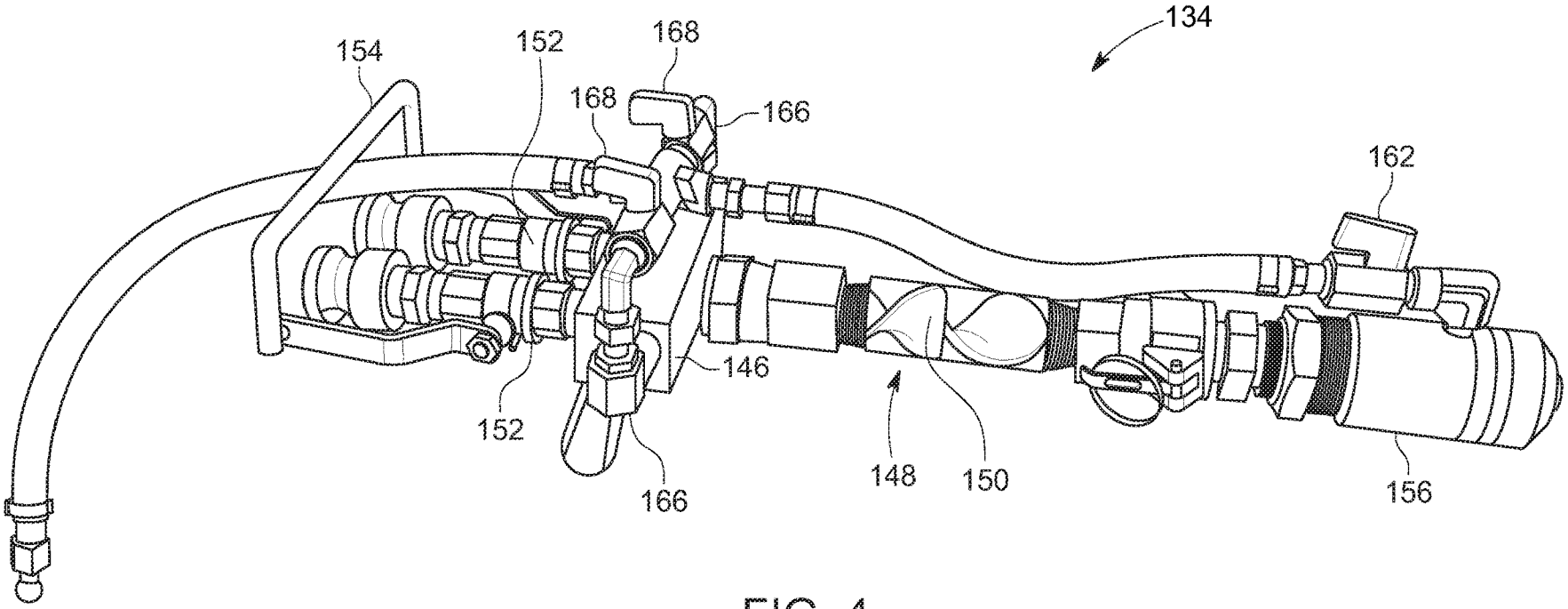
FIG. 4 is an image similar to FIG. 3, but partially broken away to reveal internal detail.

Referring to FIGS. 2, 3, and 4, first and second auger pumps are connected by respective hoses 130 and 132 to a mixing and dispensing nozzle 134. Hoses 130, 132 include couplers 136. Output ports 138, 140 of first and second auger pumps 120, 122 are matingly compatible with couplers 136. Input ports 142, 144 of mixing and dispensing nozzle 134 are also matingly compatible with couplers 136. Fluid components of the binary viscous fluid are pumped through hoses 130, 132 into input ports 142, 144, and meet at a two-into-one manifold 146. From two-into-one manifold 146, contacting but unmixed streams of the components of the binary viscous fluid pass through a mixing chamber 148. FIG. 3 shows mixing chamber 148 intact. In FIG. 4, mixing chamber 148 is shown broken away to reveal a helical mixing element 150. Helical mixing element 150 may be discontinuous, in that it may be formed by sections of a helical auger joined serially but out of radial registry typical of continuous helical augers. Of course, mixing apparatus may take forms other than that of helical mixing element 150.

Input ports 142, 144 of mixing and dispensing nozzle 134 may incorporate valves 152 operable simultaneously by a singular rotatable handle 154. In FIGS. 3 and 4, handle 154 takes the form of a bail handle. In FIG. 2, handle 154 is shown as a single lever terminating in an enlarged head. Valves 152 may be on-off valves, and may also vary flow through mixing and dispensing nozzle 134.

From mixing chamber 148, with the different components now mixed or blended, the binary viscous fluid to be applied is acted on by compressed air in an air manifold 156. Air manifold 156 enables compressed air to meet a stream of the binary viscous fluid containing aggregate, and to transmit pressure to the latter. This causes binary viscous fluid containing aggregate to be ejected. Air is supplied under pressure from air compressor 114 through a hose 158 which may be coupled to an input nipple 160 matingly compatible with connector 136 of hose 158. It will be understood that because connectors 136 are shown diagrammatically, connectors 136 of the various hoses 130, 132, and 138 may be different from one another. An air valve 162 controls flow of compressed air to air manifold 156. The greater the air flow from air compressor 114, the finer the atomization of the binary viscous fluid as it is ejected from mixing and dispensing nozzle 134. Ejection is indicated by arrow 164 in FIG. 2.

FIGS. 3 and 4 show a flushing feature for cleaning out mixing and dispensing nozzle 134. To this end, mixing and dispensing nozzle 134 may include flushing ports 166 in fluid communication with the flow path of blended binary viscous fluid. Flushing ports are isolated from the flow path to enable undisturbed dispensing operations by flushing valves 168.

Figure 8:
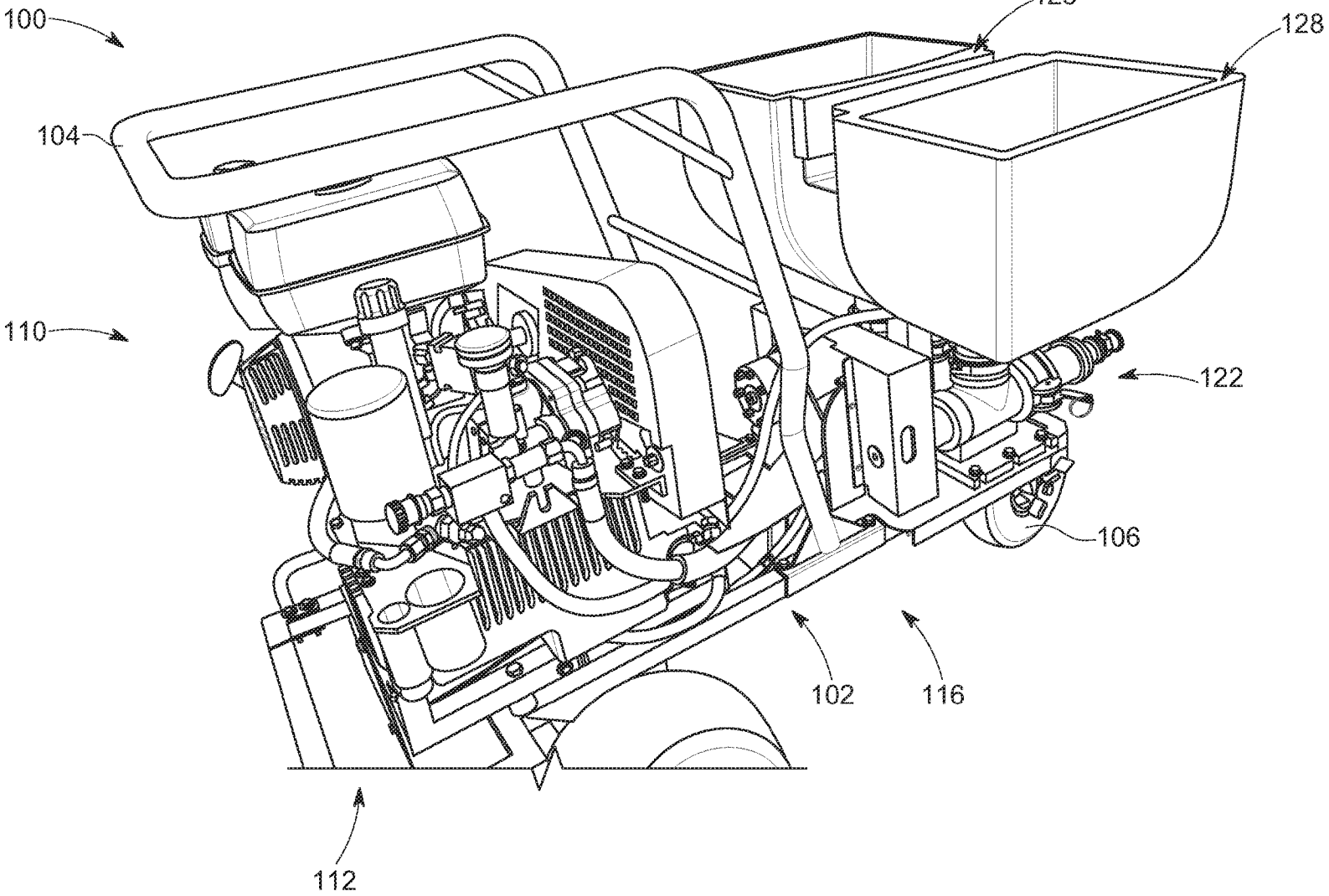
FIG. 8 is a perspective side view of the dispensing apparatus of FIG. 1.
Figure 9:
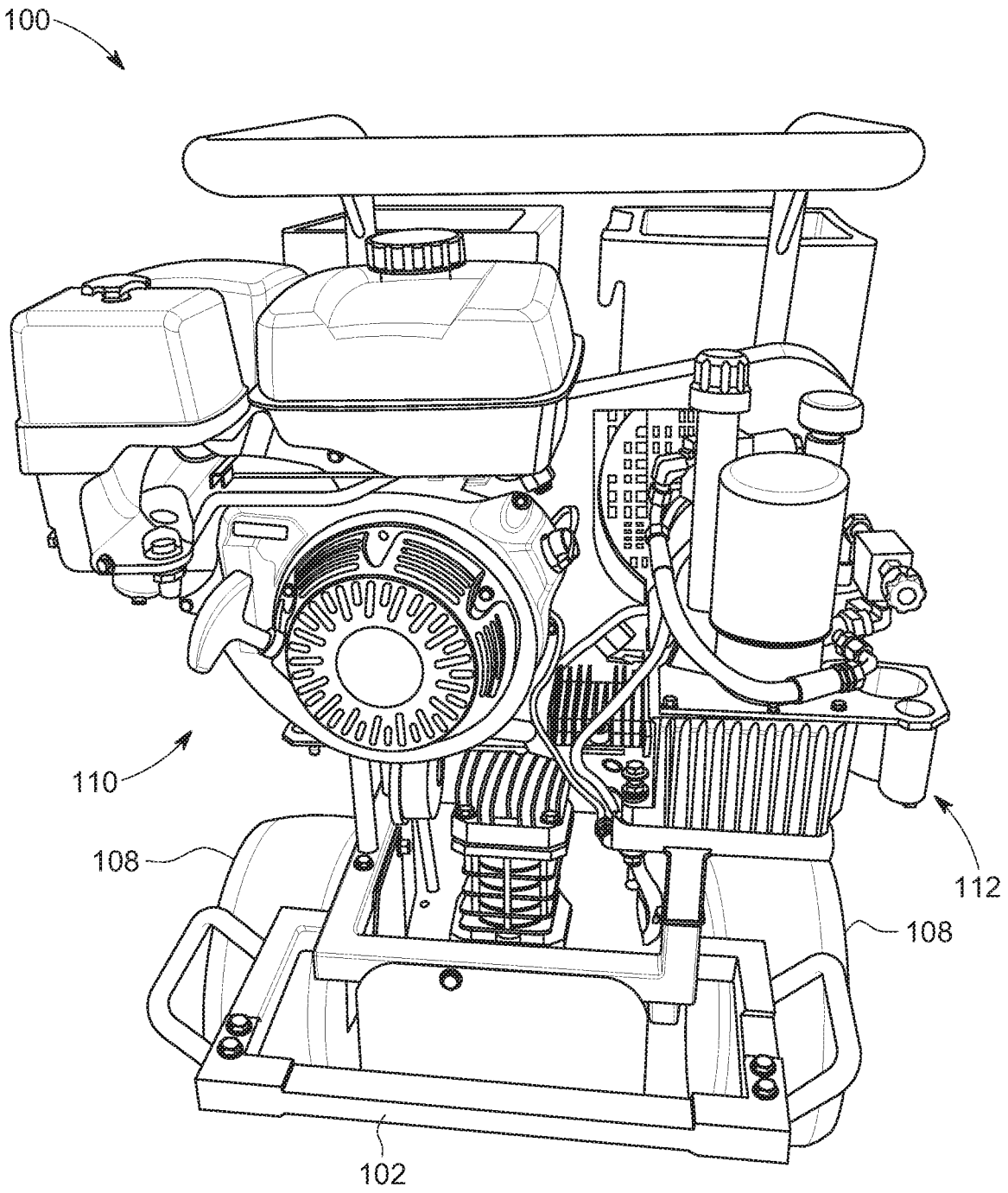
FIG. 9 is a rear perspective view of the dispensing apparatus of FIG. 1.

FIGS. 8 and 9 provide different views of novel dispenser 100. In FIG. 8, it is seen that utilities including power plant 110, hydraulic pump 112, and air compressor 114 may be located at a rear portion of dispenser 100. First and second hoppers may be located directly above respective first and second auger pumps 120, 122 at a front portion of dispenser 100. Drives and connections operably connecting the utilities and their respective first and second auger pumps 120, 122 and the pneumatic atomization system including air manifold 156 and air valve 162 may be located between the utilities and the served first and second auger pumps 120, 122 and the pneumatic atomization system.

At a minimum, the invention may be regarded as dispenser 100 for preparing and dispensing binary viscous fluids including aggregate, wherein dispenser 100 comprises chassis 102, first hopper 126 for storing a first component of a final blended viscous fluid and second hopper 128 for storing a second component of the final blended viscous fluid, wherein first hopper 126 and second hopper 128 are ultimately coupled to chassis 102, power plant 110 on the chassis, a first pump and a second pump (e.g., first and second auger pumps 120, 122) each in fluid communication with a respective one of first hopper 126 and second hopper 128 and each ultimately coupled to the chassis, a mixer (e.g., mixing chamber 148) in fluid communication with the first pump and the second pump and configured to blend inputs from the first pump and the second pump, a mechanical ratio adjuster configured to selectively establish different ratios of pump output of the first pump relative to the second pump, a fluid circuit establishing fluid communication between first hopper 126 and second hopper 128 to the respective ones of the first pump and the second pump, and an output conduit in fluid communication with the mixer, whereby a blended binary fluid may be prepared and pumped from dispenser 100 onto an environmental substrate (not shown).

As employed herein, reference to any component of dispenser 100 as being ultimately fixed or coupled to chassis 102 signifies that the referenced component may be either directly or indirectly fixed or mounted to chassis 100, possibly with intervening additional components.

It is important to note that the mechanical ratio adjuster enables the use of different components when preparing the final viscous fluid, and also enables different formulations of similar components, such that characteristics such as viscosity and drying or curing time may be varied.

Handle 104 enables dispenser 100 to be adjusted relative to a host carrier vehicle, which may be a motorized vehicle for example. This is particularly useful where dispenser 100 is a self-contained or free standing item. Provision of front and rear wheels 106, 108 enables dispenser 100 to be used as a self-contained or free standing item.

In some embodiments, dispenser 100 may comprise hydraulic pump 112 rotatably coupled to power plant 110 and hydraulic motor 116 rotatably coupled to hydraulic pump 112, wherein the first pump and the second pump are each rotatably coupled to hydraulic motor 116. This arrangement allows for adjustability in drive ratios of the first pump relative to the second pump.

Dispenser 100 may comprise air compressor 114 rotatably coupled to power plant 110 and in fluid communication with the output conduit, whereby blended binary fluid may be dispensed pneumatically. Notably, output may be in the form of a spray containing discrete particles of binary viscous material. In this form, the binary viscous material may coat an environmental substrate more evenly than would occur with a denser ejected mixture.

The mixer may comprise rotary helical mixing element 150. Helical mixing elements are practical in that they effectively mix many of the substances contemplated to be used, while contributing to pumping action to further propulsion of mixed aggregate materials.

In some embodiments of dispenser 100, at least one of the first pump and the second pump is an auger type pump such as first or second auger pumps 120, 122. Auger pumps avoid clogging and deterioration due to aggregate materials, which clogging and deterioration may occur with other pump types.

Dispenser 100 may comprise a flushing feature for cleaning out the mixer and the output conduit, comprising flushing ports 166 in fluid communication with a flow path of each component of the viscous fluid. In the binary viscous materials contemplated for use with dispenser 100, it may be desirable to flush out all enclosed components such as mixing chamber 148 with acetone. The flushing feature enables ready connection of a cleaning agent such as acetone at a point appropriate for dissolving and flushing components which could otherwise harden and become impossible to dislodge. It should be noted that materials suitable for applying markings to roads and highways, such as lane dividing stripes, restraining lines at intersections, etc., may utilize substances which cure or harden within minutes of spray application.

Novel dispenser 100 is susceptible to modifications and variations which may occur to those of skill in the art. For example, hoses 130, 132, and 138 may be provided in complementary sections as seen in FIGS. 2 and 3, rather than as single continuous hoses as shown in FIG. 2.

Figure 6:
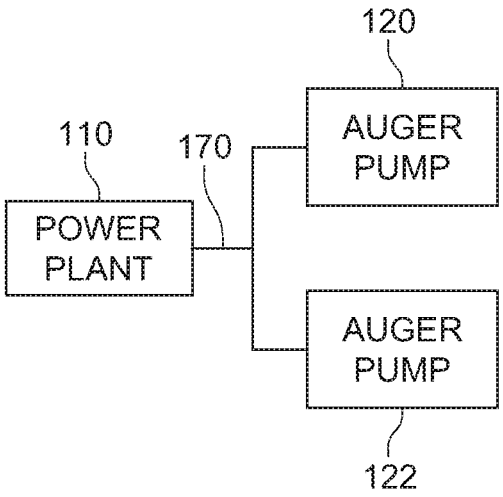
FIG. 6 is a diagrammatic view of an alternative power arrangement which may be utilized in the dispensing apparatus of FIGS. 1 and 2.

Also, and referring to FIG. 6, connection of power plant 110 to first and second auger pumps 120, 122 may be accomplished in ways other than utilizing hydraulics, as seen in FIG. 2. In FIG. 6, power plant 110 may be connected by a solid mechanical torque transfer arrangement 170, such as mechanical drive 121, or any other arrangement using torque transmitting shafts, belts, chains, gears, or other solid components.

Figure 7:
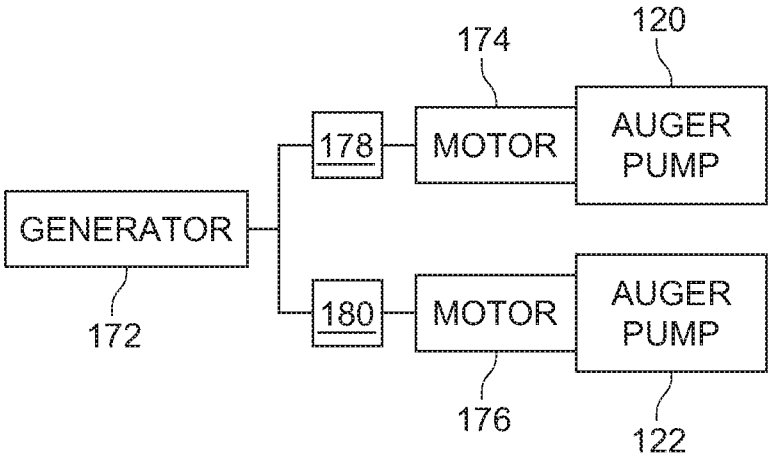
FIG. 7 is a diagrammatic view of a further alternative power arrangement which may be utilized in the dispensing apparatus of FIGS. 1 and 2.

In a further example shown in FIG. 7, hydraulic pump 112 may be replaced by a generator 172 connected to electric motors 174 and 176 through respective controllers 178 and 180. Controllers 178, 180 may be on-off type controls, or could incorporate speed variation, such as by voltage control, frequency control, or current control. Controllers 178, 180 may be eliminated in favor of a single controller if desired.

While depicted herein as being a self-standing, wheeled assembly, dispenser 100 may be integrated into or demountably coupled to a motorized service vehicle or other object, and may or may not have its own wheels.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A dispenser for preparing and dispensing binary viscous fluids including aggregate, the dispenser comprising:

a chassis;

a first hopper for storing a first component of a final blended viscous fluid and a second hopper for storing a second component of the final blended viscous fluid, wherein the first hopper and the second hopper are ultimately coupled to the chassis;

a power plant on the chassis;

a first pump and a second pump each in fluid communication with a respective one of the first hopper and the second hopper, and each ultimately coupled to the chassis;

a mixer in fluid communication with the first pump and the second pump and configured to blend inputs from the first pump and the second pump;

a mechanical ratio adjuster configured to selectively establish different ratios of pump output of the first pump relative to the second pump, wherein the mechanical ratio adjuster is a valve to selectively establish different ratios of pump output of the first pump and second pump;

a fluid circuit establishing fluid communication between the first hopper and the second hopper to the respective ones of the first pump and the second pump;

an output conduit in fluid communication with the mixer, whereby a blended binary fluid may be prepared and pumped from the dispenser onto an environmental substrate; and, a hydraulic pump rotatably coupled to the power plant and a first and second hydraulic motor rotatably coupled to the hydraulic pump, wherein the first pump is rotatably coupled to the first hydraulic motor and the second pump is rotatably coupled to the second hydraulic motor.

2. The dispenser of claim 1, further comprising a handle for maneuvering the dispenser, the handle ultimately fixed to the chassis.

3. The dispenser of claim 1, further comprising at least one front wheel and at east rear wheel rotatably coupled to the chassis.

4. The dispenser of claim 1, further comprising an air compressor rotatably coupled to the power plant and in fluid communication with the output conduit, whereby blended binary fluid may be dispensed pneumatically.

5. The dispenser of claim 1, wherein the mixer comprises a rotary helical mixing element.

6. The dispenser of claim 1, wherein at least one of the first pump and the second pump is an auger type pump.

7. The dispenser of claim 1, further comprising a flushing feature for cleaning out the mixer and the output conduit, comprising flushing ports in fluid communication with a flow path of each component of the viscous fluid.

* * * * *